United States Patent [19]

Eriksson

[11] 4,363,492

[45] Dec. 14, 1982

[54] ROLLER SKI FOR TRAINING LONG DISTANCE SKIING

[76] Inventor: Arne Eriksson, Fornminnesvägen 3, Älvängen, Sweden, 446 00

[21] Appl. No.: 216,996

[22] PCT Filed: Mar. 4, 1980

[86] PCT No.: PCT/SE80/00062

§ 371 Date: Nov. 8, 1980

§ 102(e) Date: Nov. 7, 1980

[87] PCT Pub. No.: WO80/01880

PCT Pub. Date: Sep. 18, 1980

[30] Foreign Application Priority Data

Mar. 8, 1979 [SE] Sweden ..... 7902070
Mar. 7, 1980 [FI] Finland ..... 800712

[51] Int. Cl.[3] ..... A63C 17/26; A63C 5/00

[52] U.S. Cl. ..... 280/11.1 BT; 280/11.23; 280/11.25; 280/87.04 R

[58] Field of Search ..... 280/11.1 BT, 11.1 ET, 280/11.19, 11.22, 11.23, 11.25, 87.04 R, 87.04 A; 9/310 R, 310 A

[56] References Cited

U.S. PATENT DOCUMENTS 3,767,220 11/1973 Peterson ..... 280/11.23

FOREIGN PATENT DOCUMENTS 2925555 1/1981 Fed. Rep. of Germany ..... 280/11.1 BT
7315783 5/1975 Netherlands ..... 280/11.1 BT
697135 11/1979 U.S.S.R. ..... 280/11.1 BT

*Primary Examiner*—Joseph F. Peters, Jr.
*Assistant Examiner*—Kenneth R. Rice
*Attorney, Agent, or Firm*—Holman & Stern

[57] ABSTRACT

A roller ski comprising a foot plate (6) supported by a forward and a rear pneumatic rubber wheel (7, 8) and provided with rigid supporting members (9) arranged to support the user's leg laterally at a level between the foot and the knee and at the same time to allow the leg to move freely in the longitudinal direction of the roller ski.

3 Claims, 3 Drawing Figures

ROLLER SKI FOR TRAINING LONG DISTANCE SKIING

FIELD OF THE INVENTION

The present invention relates to roller skis for training long distance skiers and of the type incorporating a foot plate with binding means adapted to retain the users' ski shoe in such a manner that its heel portion is freely pivotable about the firmly fixed toe portion. The foot plate is supported by a front and a rear wheel, whereby supporting members are arranged to extend upwards from the foot plate in order to form side supports for the users' lower leg.

DESCRIPTION OF THE PRIOR ART

Roller skis are well-known aids for training in long distance skiing when snow is not available.

These prior roller skis are designed in such a manner that they can only be used on a very smooth and even surface, preferably asphalted roads. It is of course inconvenient and unsafe for training and excersing of skiers to take place on roads close to the road traffic, and at dusk or in darkness. When great risks of accidents occur, and furthermore, these areas are not healthy environments for the roller skier, who must breathe the exhaust-mingled ambient air.

One of the reasons that the use of conventional roller skis is delimited to asphalted roads and the like is that in order to provide sufficient side-stability they are equipped with small, broad wheels, in order not to expose the skiers' ankles to very large lateral bending stresses. This design means that the roller ski will behave essentially as an ordinary ski which has rather small tendencies of wobbling laterally.

In order to imitate down-hill skiing there have also been produced special roller skis having larger wheels, but these roller skis have been provided with binding means which keep the ski boot in a fixed position, and it has also been necessary to use stiff down-hill race boots in order to obtain a sufficient stability in order to have strength enough to balance the tendencies of side tilting. It has been possible to use this type of roller ski in the terrain due to its large wheels, but due to the firm arresting of the ski boot its use has been limited to slope running, or for long distance skiing with poles only and without use of the legs.

BRIEF SUMMARY OF THE INVENTION

The purpose of the present invention is to provide a roller ski for cross-country-skiing and training or excercising therefore, the use of which is not delimited to even and smooth surfaces. This object is obtained by providing the roller ski according to the invention with supporting members formed by rigid side members extending one on each side of the foot plate in arc-form upwards from the foot plate between its forward and rear portions which function, during the pivoting of the heel portion around the binding means as lateral supports, at a level just above the ski shoe along the entire motion path of the lower leg, without thereby holding or hampering the leg in its motion in the longitudinal direction of the roller ski.

By means of this design with support for the angles, which increases the user's ability to compensate for the tendencies of canting of the roller ski, it is possible, according to another feature of the invention, to provide the roller ski with pneumatic rubber wheels, which can be used e.g. on forest paths, on prepared electric-light-illuminated snow-free tracks, etc.

BRIEF DESCRIPTION OF THE DRAWINGS

The invention will hereinafter be further described with reference to an embodiment illustrated in the accompanying drawing wherein.

DETAILED DESCRIPTION

Figure 1:
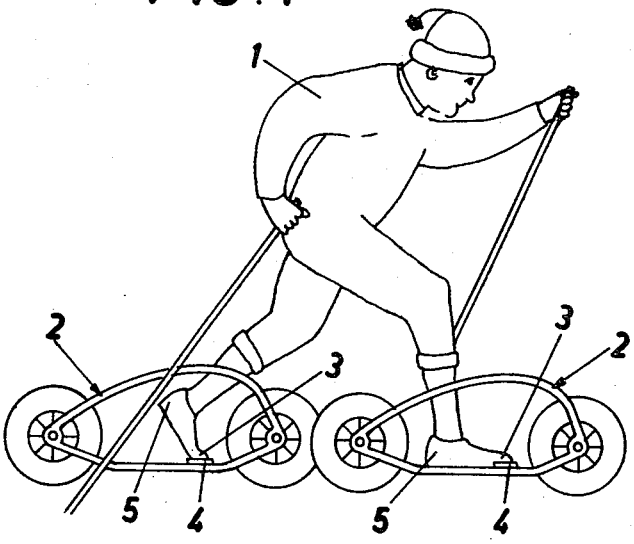
FIG. 1 shows in a schematic side view a skier using roller skis according to the invention.

In FIG. 1 is shown a side view of a roller skier 1, using roller skis 2 in accordance with the present invention. As can be seen in the position of the rearmost foot of the skier only the toe portion 3 of the ski shoe is held by the binding at 4 whereas the heel portion 5 is pivotable about the firmly held toe portion. The binding means 4 are preferably yoke bindings but cable bindings can also be used.

Figure 2:
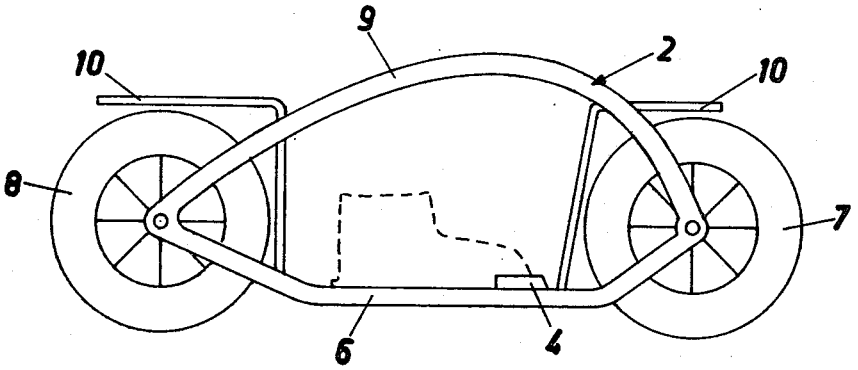
FIG. 2 is a side elevational view in larger scale of a roller ski according to the invention.

In FIG. 2 is shown in larger scale and in a side view a roller ski 2 according to the invention, and as can be seen here the roller ski comprises a foot plate 6, which is equipped with said binding means 4 and is carried by a forward and a rear wheel 7, 8. These wheels are preferably pneumatic rubber wheels of much larger size than the rigid, broad wheels of conventional designs of roller skis for crosscountry skiing.

Figure 3:
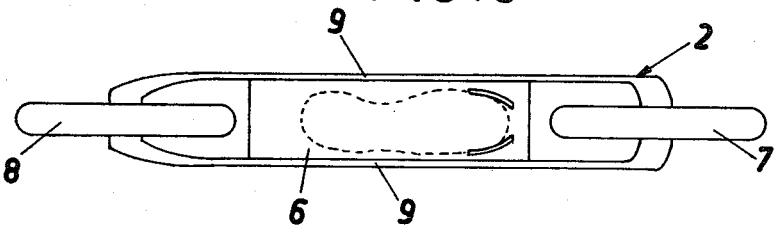
FIG. 3 is a top plan view of the roller ski according to FIG. 2.

From the foot plate 6 extends upwards, as can also be seen in FIG. 3, a side supporting member 9 at each side of the foot plate and these supporting members are preferably firm side members bent in arc-form, each one extending between the forward and rear portions of the foot plate and preferably designed to form at its ends together with the end portions of the foot plate 6 retainer means in which the hubs of the wheels 7, 8 are supported.

The supporting members 9 make such a high arc that their upper parts independent of the position of the foot always will be situated above the ski shoe which is held by the binding 4 and on each side of the users' lower leg, whereby they give a safe lateral support for the leg. As the supporting members 9 have essentially the same spaced relationship between them along their length from the forward to the rear wheel hubs, the natural movement of the leg when the foot pivots about the toe binding will not be hampered or obstructed. The user of the roller ski according to the invention will thereby make the same movement pattern as in real skiing. As the legs all the time will be laterally supported by the side members 9, the use is not limited to plane or flat surfaces and with wheels which have very little tendency of tip over, but it is instead possible to counteract and substantially prevent tipping of the roller skis. It is hereby possible to use pneumatic wheels 7, 8 which in turn means that it is possible to use the roller ski according to the invention also on terrain, on comparatively soft ground etc, and therefore the roller skier will have a freedom of chosing the site for his practising track and is spared from running on asphalted roads and the like.

As can be seen from FIG. 2 the roller ski according to the invention can preferably be provided with mud guards 10 over the wheels.

The invention is not limited to the embodiment shown in the accompanying drawing but modifications are possible within the scope of the following claims.

I claim:

1. A roller ski for training skiers of the type having a foot plate with binding means adapted to retain the user's ski shoe in such a manner that the heel portion is freely pivotable about the firmly fixed toe portion, and which foot plate has rotatably mounted thereon a forward and a rear wheel, comprising supporting members arranged to extend upwards from the foot plate to form side supports for the user's lower legs, said supporting members being rigid side members which extend on each side of the foot plate in arc-form upwards from the foot plate between its forward and rear portions for providing, during the pivoting of the heel portion around the binding means, lateral supports at a level just above the ski shoe, along the entire motion path of the lower leg, without thereby holding or hampering the leg in its motion in the longitudinal direction of the roller ski.

2. A roller ski according to claim 1, wherein said supporting members extend between the positions where the forward and rear wheels are mounted at each side of the foot plate.

3. A roller ski according to any one of the preceding claims, wherein said wheels are pneumatic rubber wheels.

* * * * *